US006974055B2

(12) United States Patent
Moore et al.

(10) Patent No.: US 6,974,055 B2
(45) Date of Patent: Dec. 13, 2005

(54) ADAPTER FOR A MANUALLY OPERATED DISPENSING DEVICE OF CONTAINERS OF LIQUID

(75) Inventors: David Moore, Camdenton, MO (US); Reinhard Neuhaus, Hemer (DE); Ralf Jordan, Dortmund (DE); Detlef Schmitz, Lünen (DE); Bernhard Jasper, Waltrop (DE); Peter J. Walters, Barrington, IL (US)

(73) Assignee: Seaquist Perfect Dispensing GmbH, Dortmund (DE)

( * ) Notice: Subject to any disclaimer, the term of this patent is extended or adjusted under 35 U.S.C. 154(b) by 0 days.

(21) Appl. No.: 10/297,377

(22) PCT Filed: May 31, 2001

(86) PCT No.: PCT/EP01/06208

§ 371 (c)(1),
(2), (4) Date: Apr. 24, 2003

(87) PCT Pub. No.: WO01/94257

PCT Pub. Date: Dec. 13, 2001

(65) Prior Publication Data

US 2003/0160071 A1 Aug. 28, 2003

(30) Foreign Application Priority Data

Jun. 5, 2000 (DE) ..... 100 27 740
Jun. 5, 2000 (DE) ..... 200 10 029 U

(51) Int. Cl.[7] ..... G01F 11/06

(52) U.S. Cl. ..... 222/321.4; 222/321.9; 222/494

(58) Field of Search ..... 222/321.4, 321.7, 222/321.9, 380, 383.1, 494

(56) References Cited

U.S. PATENT DOCUMENTS 2,119,884 A * 6/1938 Lohse ..... 222/182
4,277,001 A * 7/1981 Nozawa ..... 222/321.4
4,371,098 A 2/1983 Nozawa et al.
4,723,692 A * 2/1988 Meuresch et al. ..... 222/402.19
6,186,372 B1 2/2001 Garcia et al.

FOREIGN PATENT DOCUMENTS

| | | |
|---|---|---|
| DE | 28 17 393 A1 | 10/1979 |
| DE | 30 45 565 A1 | 6/1982 |
| EP | 0 043 514 A | 1/1982 |
| EP | 0 974 533 A | 1/2000 |
| GB | 888 217 A | 1/1962 |
| GB | 2 058 229 A | 4/1981 |

OTHER PUBLICATIONS

International Preliminary Examination Report for international application PCT/EP01/06208.
Two–page Search Report appended to WO 01/94237.

* cited by examiner

*Primary Examiner*—Joseph A Kaufman
(74) *Attorney, Agent, or Firm*—Wood, Phillips, Katz, Clark & Mortimer

(57) ABSTRACT

The invention relates to an adapter (2) for a manually operated dispensing device (120) for a fluid that is/can be pressurized in a container. The dispensing device includes a housing (148) having a passage channel (30). A tubular adapter housing (34) connects the uptake tube (32) and the channel (30) of the housing (148) of the dispensing device (120). The adapter housing (34) has a connecting sleeve (42) for connection to the connecting nipple of the housing (148) and an uptake tube sleeve (44) for connection to the uptake tube (32). There are several inlets (46) for the fluid in the upside down position of the dispensing device. The adapter housing (34) defines at least one section of the inlets. An inlet valve (48) is defined within the adapter housing (34) for releasing the inlets substantially simultaneously when a pressure acts on the fluid in the container in the substantially upside down position of the container. A shut-off valve (50) is positioned inside a large diameter valve chamber (52) of the adapter housing (34), in such a way that the valve (50) can be freely displaced axially between two end positions.

8 Claims, 12 Drawing Sheets

ADAPTER FOR A MANUALLY OPERATED DISPENSING DEVICE OF CONTAINERS OF LIQUID

This application is an application filed under 35 U.S.C. Sec. 371 as a national stage of international application PCT/EP01/06208, which was filed May 31, 2001.

TECHNICAL FIELD

The invention relates to an adapter for a hand-operated dispensing device for a fluid that is/can be placed under pressure in a container in the substantially upright position thereof and in the substantially reversed or upside-down position.

BACKGROUND OF THE INVENTION

Dispensing devices in the form of hand-operated pumps for containers for fluids or dispensing valves for containers for fluids subjected to the pressure of propellant gas are known, which are assigned an auxiliary valve to let in fluid from a container which adopts an oblique or substantially reversed or upside-down position. In these conventional devices, the auxiliary valve consists of a ball valve which is assigned to the pump housing or valve housing of the dispensing device in question. The ball valve is mounted to be freely and reciprocally movable parallel to the axis between an open position and a closed position. It is exclusively subjected to gravity, so that the ball valve adopts its final position more or less quickly—or not at all—as a function of the oblique position of the container and of the viscosity of the liquid therein. This results, inter alia, in a nonuniform dispensing of the fluid in the container as a consequence of a differing admixing of air and is perceived by the consumer as disadvantageous. This disadvantage is particularly noticeable in the case of cosmetic or pharmaceutical products, where the consumer relies on dispensing a particular quantity of the product when actuating such dispenser packs.

SUMMARY OF THE INVENTION

It is therefore an object of the present invention to propose an adapter which can be optionally used in conjunction with conventional hand-operated pumps or dispensing valves on containers subjected to the pressure of propellant gas and, furthermore, can also be used in any position of a container differing from the normal, upright position thereof, such as an upside-down or oblique position of the container, which guarantees a consistently uniform quantity of fluid. Any dispensing device designed exclusively for actuation and functioning in the upright position of the container will be capable of being employed, by use of the adapter according to the invention, for actuation and dispensing of the liquid from the container in the reversed or upside-down position of the container.

What is achieved by the adapter according to the invention is that any dispensing device created for dispensing fluid in the normal, upright position of a container can, by attachment of the adapter to the lower end of the housing of the dispensing device in question, be converted into and used as a universally usable dispensing device which, in any desired position of the container, always and reliably dispenses a consistently uniform quantity of discharged fluid.

BRIEF DESCRIPTION OF THE DRAWINGS

The invention is described in detail below with reference to the diagrammatic drawings of a plurality of examples of embodiment, in which.

DETAILED DESCRIPTION OF THE PREFERRED EMBODIMENT

Figure 1:
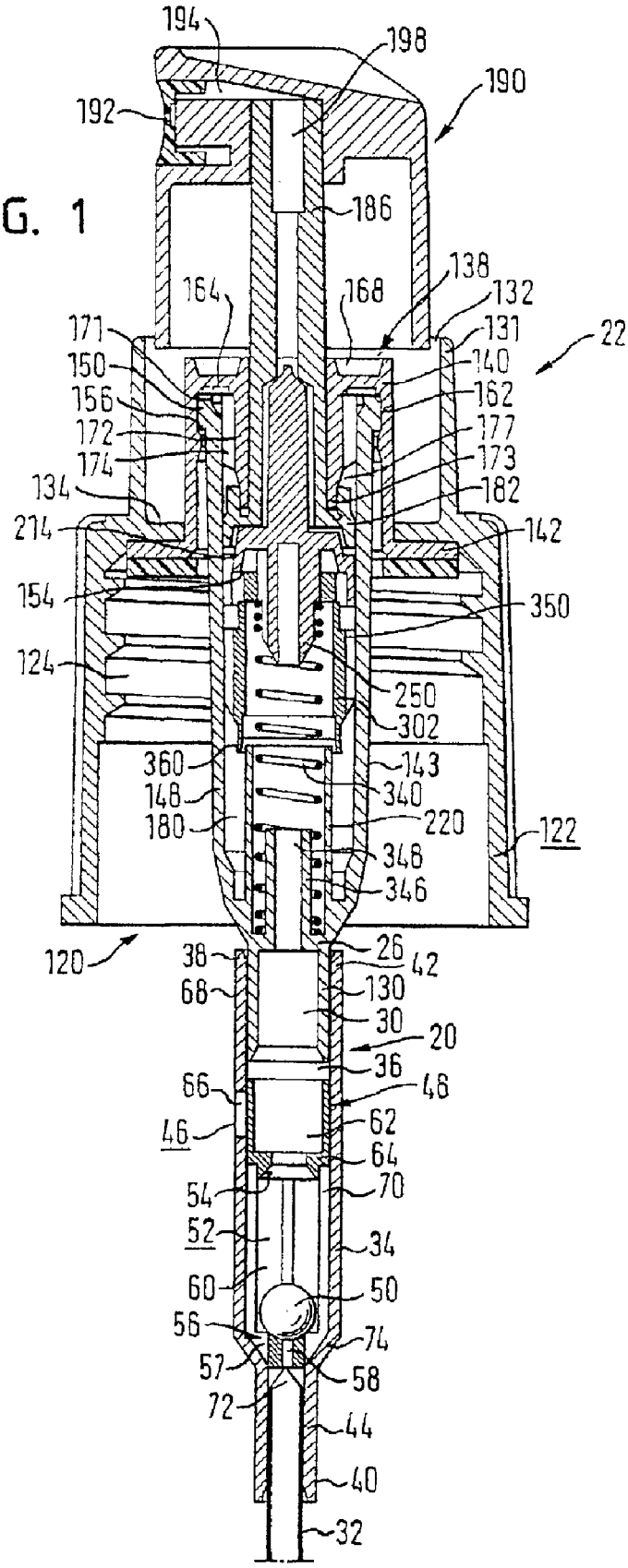
FIG. 1 shows an embodiment of an adapter according to the invention in conjunction with a conventional, hand-operated pump in a central longitudinal section.

FIG. 1 shows an adapter 20 for a hand-operated pump 120 as a dispensing device for a fluid which is, or can be, subjected to pressure in a container (not shown) in the substantially upright position thereof and in the substantially reversed or upside-down position thereof. The dispensing device 22 comprises a housing 148, which, as is known per se and therefore not shown is sealingly secured on an aperture at the upper end of the container. The housing 148 is provided with a base 26, at whose lower end a connecting nipple 130 is disposed. A passage channel 348, extends through the base 26 and connecting nipple 130 and, for the passage of the fluid in the substantially perpendicular position of the container, is in connection with an ascending pipe 32 extending into the fluid in the container.

A tubular, substantially cylindrical adapter housing 34 contains a linking channel 36 between the ascending pipe 32 and the passage channel 30 of the housing 148 of the dispensing device 22. The adapter housing 34 has an upper end 38 and a lower end 40, which respectively form a connecting pipe 42 for the connecting nipple 130 and an ascending pipe nipple 44 for the ascending pipe 32. A plurality of inlets 46 for the fluid are provided in the wall of the adapter housing 34, which are disposed at equal circumferential angular intervals at mid-height of the adapter housing 34. These inlets 46 permit the passage of fluid from the container in the substantially reversed position of the container, as is explained in detail below.

In the embodiments of the adapter 20 according to the invention shown in FIGS. 1 to 7, an inlet valve 48 is inserted into the adapter housing 34 as an independent or separate component to be non-displaceable axially.

The inlet valve 48 is provided within the adapter housing 34 for the approximately simultaneous closure of the inlets 46 in the approximately upright position of the container, but for the approximately simultaneous clearance of the inlets 46 in the event of a pressure difference acting on the fluid in the container in the substantially reversed position of the container.

A non-return valve 50 is disposed within a valve chamber 52 of the adapter housing 34 to be freely movable axially between two end positions, the upper end position being defined by a non-return valve seat 54 extending transversely through the adapter housing 34 and the lower position by a supporting device 56 in the upright position of the container, on which supporting device 56 the non-return valve 50 adopts a throttle position for the fluid, leaving throttle ports 58 free.

The valve chamber 52 has a diameter which is greater in size than the diameter of the non-return valve 50, in order to form bypass flow channels 60 for the fluid in the upright position of the container.

The inlet valve 48 is produced from a flexibly elastic material, such as silicone or polyethylene, and consists of a valve sleeve 62 with a sleeve base 64 and is supported within the adapter housing 34 at a distance below the inlets 46 by the supporting device 56. The inlets 46 consist of a plurality of inlet ports 66 provided at the same height and at the same circumferential angular intervals in the cylindrical wall of the adapter housing 34. The inlet ports 66 are sealed, in the upright position of the container, by the valve sleeve 62 but, in the event of a pressure in the adapter housing 34 lower than that prevailing in the container, are opened by a radially inward-directed bulging of the valve sleeve 62.

The supporting device 56 consists of at least three supporting ribs 70, which are disposed at equal circumferential angular intervals and extend radially inwards from the interior wall of the valve chamber 52 and upwards from the lower end 40 of the adapter housing 34 and end at a distance below the inlet ports 66. The valve sleeve 62 is supported by its sleeve base 64 on the upper end faces of the supporting ribs 70. The supporting ribs 70 simultaneously serve to guide the coaxially movable non-return valve 50 in the valve chamber 52. Intervening spaces, which are disposed in the circumferential direction of the interior wall of the adapter housing 34 between the supporting ribs 70, form the bypass flow channels 60 through which the fluid can flow past the non-return valve 50 toward the dispensing device 22.

The lower end 40 of the adapter housing 34 forms a tapered longitudinal section 74, whose lower end forms the ascending pipe nipple 44 of smaller diameter. The supporting ribs 70 extend into the tapered longitudinal section 74, and project radially inward, in order to form the throttle seat for the non-return valve 50. As a result, on the first pump stroke in the upright position of the container, the air contained in the housing 148 can be forced past the non-return valve 50 through the throttle seat thereof into the container. The support ribs 70 adopt a distance from one another, diametrally relative to the valve chamber 52, which corresponds to the clear diameter of the ascending pipe nipple 44 and is smaller in size than the diameter of the non-return valve (50), in order to form bearing ribs 57 for the non-return valve 50.

The ascending pipe 32 has an upper end 72 which is chamfered at an angle of 90° from its center to both sides in the manner of a gabled roof. This shape of the end 72 of the ascending pipe offers the possibility of dispensing with the support device 56 for the non-return valve 50 and, instead, supporting the spherical non-return valve 50 only on the gable-like end 72 of the ascending pipe 72, because in this case also throttle ports for the discharge of product residues when the pump 120 is placed under pressure exist to the side of the two mutually opposite tips of the end 72 of the ascending pipe.

Although the adapter according to the invention, as stated initially, can be used with any desired pressure or pump system, the mode of operation of the adapter will be explained below with reference to the metering pump shown in FIGS. 1 and 2, which is known per se.

Figure 2:
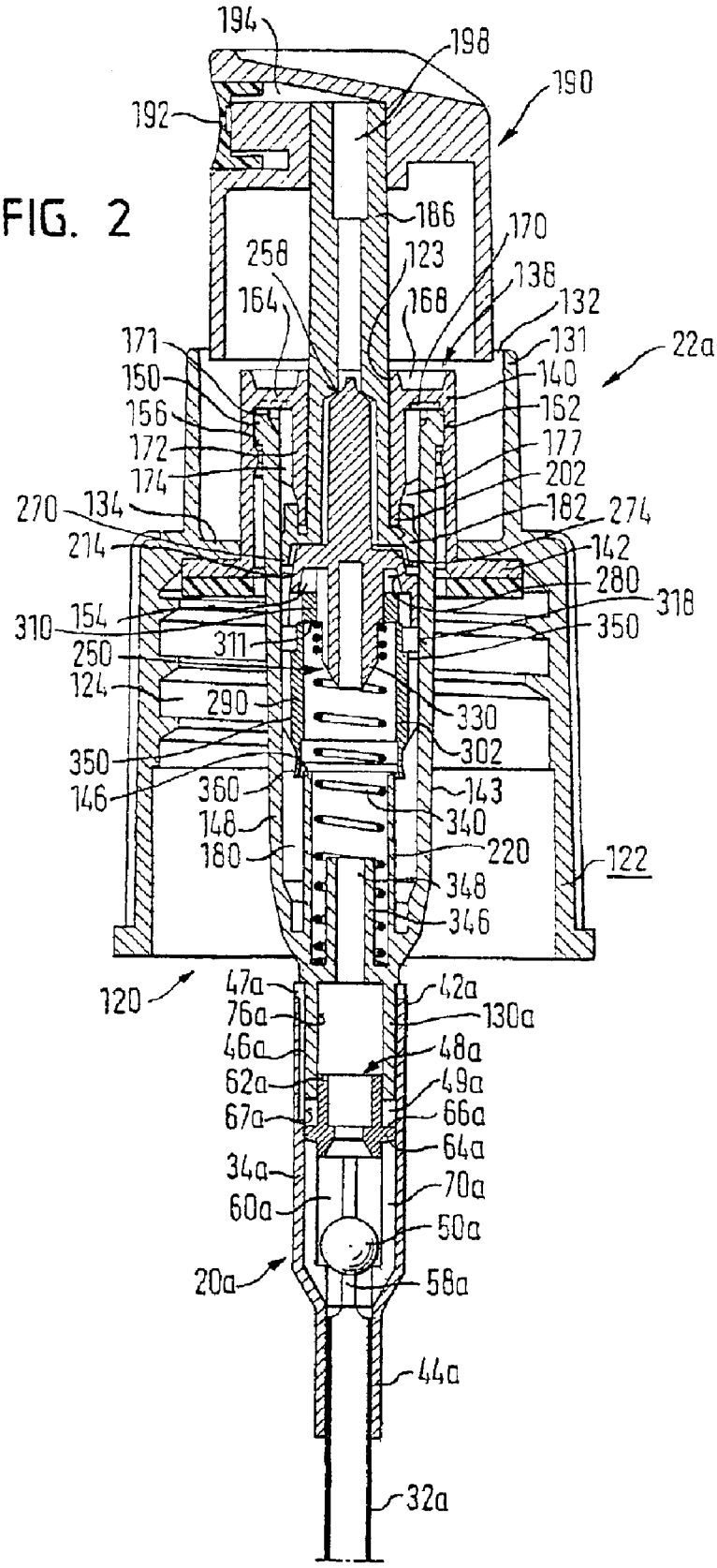
FIG. 2 shows a modified embodiment of an adapter in conjunction with the hand pump shown in FIG. 1, in a central longitudinal section.

FIGS. 1 and 2 show a metering pump 120 as a dispensing device. The pump is fixed in a closure cap 122, which comprises suitable means, for example a helical thread 124, for fixing the cap together with the pump 120 disposed therein on the open top of a conventional container.

The container (not visible below the pump 120) is filled with a fluid product. The fluid product is aspirated into the pump 120 through the connecting nipple 130, which is connected to the underside of the pump 120. The adapter 20, as already described above, is fixed by its upper, tubular end 38 to the connecting nipple 130 and receives in its lower ascending pipe nipple 44 the upper end of the ascending pipe 32, which extends as far as the bottom of the container. The lower end of the ascending pipe 32 is therefore normally dipped into the fluid, when an associated container is in the general upright position.

The closure cap 122 has a generally cylindrical hollow wall 131, an interior cylindrical aperture 132 being formed above and separate from the helical thread 124 by an annular flange 134 which projects inward. Within the aperture 132 is located a holder 138, which comprises an exterior wall 140, which at its lower end forms an outward-projecting annular flange 142. The annular flange 142 is fixedly disposed and sealed relative to the top of the container aperture. The holder 138 serves to secure the pump 120 in the cap 122. To this end, the pump housing 148 is provided with an upper flange 150, which protrudes outward. The flange 150 has a radially inward-projecting shoulder on the exterior wall 140 of the holder 138. The holder 138, in order to secure the pump housing 148, can easily be secured on the pump housing 148 by means of a snap seating and be connected thereto.

The pump housing 148 comprises a substantially cylindrical pump chamber 180, which is open at the upper end and into which a cylindrical inner sleeve 172 of the holder 138 engages. The inner sleeve 172 is disposed coaxially with the exterior wall 140 of the holder 138 and connected to the latter at the upper end by an annular end wall 164. The inner sleeve 172 ends in a tapered lower end 173 within the pump chamber 180.

The flange 150 at the upper end of the pump housing 148 is provided with a vertical groove 162, which is shown in the right-hand halves of FIGS. 1 and 2. The groove 162 forms an air outlet slit between the pump housing 148 and the exterior wall 140 of the holder 138 and interacts with certain venting channels in the holder 138. In particular, the upper, annular end wall 164 forms a circumferential groove 168 at the top of the container 138. The groove 168 is linked to the top of the groove 162, as is shown in the right-hand halves of FIGS. 1 and 2. The groove 168 is linked, in a position offset by 180° relative to the groove 162, to a radial groove 170 (FIG. 2), which is provided in the bottom of the upper end wall 164 of the holder 138. The groove 170 extends inward beyond the wall of the pump housing 148.

The cylindrical inner sleeve 172 of the holder 138 is connected to a plurality of ribs 174, which are disposed to be distributed at a distance from one another over the circumference and project outward. The vertical exterior surfaces of the ribs 174 rest on the interior wall of the pump housing 148 and serve for the coaxial orientation of the holder 138 and of the pump housing 148.

The entire circumference of the upper interior edge of the pump housing 148 is conically widened, in order to form an annular channel 171 around the holder 138 at the upper ends of the ribs 174. The intervening spaces between the ribs 174 link an annular space 170 below the ribs 174 at the lower end of the cylindrical inner sleeve 172 of the holder 138 to the annular channel 171, which extends around the upper ends of the ribs 174. This provides a venting channel, which extends out from the interior of the pump housing 148 through the radial groove 170, around the circumferential groove 168, out through the groove 162 over the shoulder 156 and then downward between the cylindrical exterior wall 140 of the holder 138 and of the pump housing 148 into the inner head space of the container above the fluid. This venting channel, together with other components of the pump, permits atmospheric air to penetrate into the container, as is described below.

A pump piston 182 is so disposed that it can be sealingly and reciprocally moved within the pump chamber 180. The pump piston 182 is provided with a hollow cylindrical shank 186, which extends upward and projects outward from the pump chamber 180 through the holder 138 via the cap 122. The cylindrical piston shank 186 is adapted to an actuating and dispensing head or button 190, which is provided with a dispensing aperture 192, which is linked to the upper end of the piston shank 186 via a radial outlet channel 194. An axial outlet channel 198 extends upward through the pump piston 182 and the shank 186 thereof and links the outlet channels 194 within the actuating head 190 to the pump chamber 180.

The outside of the piston shank 186 is tapered toward the upper end, so that its diameter increases with increasing height above the holder 138. The lower end of the pump piston 182 forms a sealing surface, concave toward the base 26 (FIG. 2), for the lateral surfaces of the lower end of the inner sleeve 172 of the holder 138 in order to rest thereon and provide a seal when the pump piston 182 is disposed in the fully raised position of rest as shown in FIGS. 1 and 2. If however, the pump piston 182 is partially or substantially fully depressed, the concave sealing surface 202 of the pump piston 182 moves away from the lower end of the interior wall 172 of the holder 138.

As a consequence thereof, ambient air can penetrate into the container in order to top up the volume of the dispensed content and maintain the atmospheric air pressure within the container. When this occurs, ambient air flows into the cap aperture 132 and also under the actuating head 190.

When the piston shank 186 is disposed in its lowered position, the air flows through an annular gap 123 (FIG. 2) past the cylindrical inner sleeve 172 of the holder 138 and of the pump housing 148. The air then flows through the radial groove 170 and the circumferential groove 168. Here it is distributed in other directions, around the circumference of the holder 138 through approximately 180°, where it then flows through the groove 162 of the pump housing 148. The air then flows between the holder 138 and the pump housing 148 and downward into the container.

Fluid is fed via the connecting nipple 130 and a suction channel 348 to the pump chamber 180 through a fixed feed line, which in the preferred embodiment shown consists of a cylindrical tubular feed part 220, which projects from the base of the pump housing 148 into the pump chamber 180 and inside the latter and has an open upper end.

A second differential piston is made up of two parts, specifically a valve body 250 and a sealing sleeve 290 (FIG. 2). The valve body 250 is axially oriented above the stationary, tubular feed part 220 and also disposed in a manner such that it is movable with the pump piston 182 and relative thereto above the tubular feed part 220. The pump piston 182 encloses an enlarged bore, the upper end of which leads into the outlet channel 198 of smaller diameter at a point which is formed by an annular valve seat 258. The valve body 250 is molded onto the upper end of a valve cone, which rests firmly against the annular valve seat 258 in the pump piston 182, in order to prevent fluid from flowing out from the pump chamber 180 through the outlet channel 198.

The lower end of the valve body 250 is configured as a valve head 270. The valve head 270 has an upper piston surface which is provided with four ribs 274, which extend outward at equal circumferential angles and project from the upper piston surface. The piston surface of the valve head 270 is placed under the pressure of the fluid in the pump chamber 180, as is described in detail below.

The underside of the valve head 270 is provided with an annular groove of trapezoidal cross section and represents an integral part of an inlet valve. To this end, the outer lateral wall of the annular groove forms a valve surface 280, which is conically widened downward and outward to seal the upper conical contact surface 318 of a sealing sleeve 290, which is linked to the valve body 250 in a manner such that it is capable of limited axial adjustment. The valve surface 280 and the conical contact surface 318 form an essentially identical acute-angled aperture with the central longitudinal axis 0—0 of the pump in the downward direction. The inner lateral wall of the annular groove is formed by a cylindrical guide pin 330.

The sealing sleeve 290 is provided, on its side facing the container, with a substantially cylindrical piston shell 302. The upper end of the sealing sleeve 290 has an inner annular flange 310, whose underside forms a shoulder 311, which rests on the upper end of a helical compression spring 340 when the pump piston 182 is disposed in its upper, inactive position. In this inactive position, the inlet valve (channel 154) is open. The annular flange 310 can be adjusted axially out of this inactive position into a working position in which the inlet valve is closed. The annular flange 310 extends with its shoulder 311 and its upper front side at right angles to the pump axis 0—0 and axially into an annular groove 279 of the valve head 270.

As a result of the lower stop for the sealing sleeve 290, formed by the upper end of the helical compression spring 340, a free space is created, which permits a limited axial movement between the valve body 250 and the sealing sleeve 290. This relative mobility of the sealing sleeve 290 is provided here in a manner such that the contact surface of the sealing sleeve 290 rests on the inner valve surface 280 of the outer edge of the valve head 270 in one end position of the range of relative movement of the sealing sleeve 290, so that the inlet valve formed by said parts is closed. The circumstances in which this relative movement from one end position to the other end position takes place are described in detail below.

The piston shell 302 of the sealing sleeve 290 is provided with guide ribs 350 which project outward and are disposed at a distance apart over the circumference, and by means of which the sealing sleeve 290 is displaceable along the interior wall of-the pump chamber 180, in order to maintain the axial orientation of the sealing sleeve 290 within the pump chamber 180 and relative to the tubular feed part 220.

The lower end of the sealing sleeve 290 is so formed that it can be telescopically deformed downward in a sealing manner in firm contact along the outside of the stationary tubular feed part 220. To this end, the lower end of the sealing sleeve 290 is provided with an annular beading 360, which projects inward to rest on the outside of the tubular feed part 220 when the movable sealing sleeve 290 moves downward, as is explained below.

According to FIG. 1, the spring 340 is disposed with its lower end within the pump chamber 180 at the base and within the tubular feed part 220 and engages around a lower guide pin 346, which is disposed coaxially with the main axis of the pump and protrudes upward from the base of the housing. The guide pin 346 is an integral part of the pump housing 148 and, with its inlet channel 348, links the adapter 20 to the tubular feed part 220. It is apparent that the spring 340 normally prestresses the valve body 250 together with the pump piston 182 resting thereon into a fully raised position, when the pump is in its inactive position of rest.

The valve head 270 is provided on the circumference outwardly and downwardly resembling a fruston with a plurality of ribs (not shown), which are disposed at a distance apart from one another over the circumference and extend downward along the interior wall of the pump housing 148 and assist the axial guidance of the valve body 250.

The sealing sleeve 290 follows this movement for a short time, while the annular flange 310 is supported by its shoulder 311 on the restoring spring 340. If, however, the lower free end of the sealing sleeve 290 encounters the tubular feed part 220, the movement of the sealing sleeve 290 is briefly interrupted. However, the upper end of the sealing sleeve 290, briefly halted at the tubular feed part 220, is rapidly reached by the valve head 270, so that both parts adopt the closed position. From this moment on, the valve head 270 carries the sealing sleeve 290 downward with it, so that the sealing sleeve 290 slides telescopically and sealingly over the tubular feed part 220. The friction deriving therefrom contributes to a relative pressure of the inner flange 310 on the annular groove, so that the linking channel 154 between the contact surface 318 of the sealing sleeve 290 and the valve surface 280 of the valve head 270 is closed or sealed. From this moment onward, which additionally begins immediately after the start of operation of the pump, the pump chamber 180 is completely closed. The depression of the pump piston 182 now causes an increase of the pressure in the pump chamber 180.

It must be emphasized, however, that this behavior is greatly dependent on the choice of that point at which the inner flange 310 is supported on the valve body 250. Specifically, while the pressure P in the pump chamber continues to increase, an axial, outward-oriented force is added to the abovementioned friction between the sealing sleeve 290 and the guide pin 346. If "s" is the cross-sectional region of the ribbed groove that extends from the inside of the pump shell 302 of the sealing sleeve 290 to the interior wall of the pump chamber 180, the force obtained is the product of "s" and "P". Even if "P" is enlarged only slightly, the force by far exceeds the friction of the sealing sleeve 290 on the tubular feed part 220 and is therefore critical for the firm closure of the linking channel 154. If this linking channel 154 is located at a distance from the main axis 0—0 of the metering pump such that an angular range having the cross section "S" for the fluid under pressure "P" is accessible between the bearing surface of the sealing sleeve 290 on the valve body 150 and the interior wall of the pump cylinder 143, an axial force "SP" develops which is oriented toward the container and which counteracts the force "sP" and tends to force back the sealing sleeve 290 and open the linking channel 154. It is therefore necessary to ensure in all circumstances that "S" is less "s". While the pump chamber 180 is placed under pressure, the closing of the linking channel 154 is better the smaller "S" is relative to "s". The embodiment shown in the figure is an optimum where "S" equals 0. In this phase of the placing of the pump under pressure, therefore, all actions take place in a manner as if the sealing sleeve 290 and the valve body 250 were inseparably linked to one another. The fluid enclosed in the pump chamber 180 is then dispensed as with conventional pumps.

However, this analogy no longer applies to the subsequent working phases of the pump. As soon as the force "F" is no longer being applied, the restoring spring 340 forces back the valve body 250. The valve body 250 moves away from the sealing sleeve 290, which as a consequence of the friction on the tubular feed part 220 is held stationary. The sealing sleeve 290 therefore moves out of the closed position into the open position. The linking channel 154 between the valve head 270 and the annular flange 310 of the sealing sleeve 290 is open and therefore provides a link between the container and the pump chamber 180 via the intervening spaces or grooves which are disposed between the guide ribs 350. The restoring spring 340, on which the inner shoulder 311 of the annular flange 310 rests, now carries the valve body 250 with it at the same time as the sealing sleeve 290. This results in an increase in volume in the pump chamber 180. As the linking channel 154 is open, fluid is let into the pump chamber 180. The linking channel 154 makes it possible to fill the pump chamber 180 to an extent whereby the volume of the pump chamber 180 increases. If, therefore, the metering pump 120 has completely returned to its initial position or position of rest and the link between the free lower end of the sealing sleeve 290 and the upper end of the tubular feed part 220 is restored, fluid is no longer aspirated through the tubular feed part 220. Theoretically, therefore, the link would become superfluous. That, however, would mean that a gas-tight contact between the tubular feed part 220 and the end of the sealing sleeve 290 would have to be maintained constantly, and its quality would inevitably deteriorate to the detriment of the plastic flow of the plastic components.

When the metering pump is actuated, the linking channel 154 therefore closes approximately at the same time as the link 146 is interrupted. However, when the pump piston 182 moves upward, the linking channel 154 opens before the link is restored. A significantly lower vacuum therefore occurs in the pump chamber 180. It follows that only a little air, if any at all, can penetrate, even when the seal of the pump piston 182 relative to the pump cylinder 143 should no longer be particularly tight. In particular, the pump piston 182 in this case needs only a single sealing lip 214. This single sealing lip 214 is directed toward the container, so that, during dispensing of the fluid, the pressure prevailing in the pump chamber 180 continues to increase the sealing effect. Dispensing with one of the two sealing lips reduces the friction of the pump piston 182 of the pump cylinder 143 by half. The spring 340 need not therefore be as powerful as previously, in order to move the pump piston 182 and the valve body 250 back upward again. The operative who compresses the restoring spring 340 during the downward movement of the pump piston 182 therefore needs to apply a lesser force F, which is in a more favorable ratio to the force exerted by the finger of a child. All these advantages are achieved with one additional part, specifically the sealing sleeve 290, which represents a special part. This improves the quality of spraying, which ensures the dispensing of a uniform metered volume independently of the age of the metering pump. The two fitted-together parts 250 and 290 of the differential piston therefore interact via the restoring spring 340 and permit the aspiration of the fluid during the actuation of the metering pump. The pump chamber 180 is then filled with air, which is generally the case when the metering pump is operated for the first time, the pressure in the pump chamber 180 not increasing to such an extent, as a result of the downward movement of the movable parts 182, 250, 290 within the pump housing 148, that the outlet valve 258, 262 could be opened. During the output movement of conventional pistons, therefore, the vacuum in the pump chamber 180 necessary for the access of fluid is not present. This disadvantage is eliminated by the fact that the linking channel 154 between the pump chamber 180 and the container opens immediately on commencement of the upward movement of the pump piston 182. As a consequence thereof, air can again be distributed, but on this occasion in the opposite direction. In this manner, air flows from the pump chamber 180 into the container. In the course of the further upward movement of the pump piston 182 a vacuum is simply produced by the increase in the volume in the pump chamber 180 which, as desired, aspirates fluid into the pump chamber 180 and fills the latter with fluid.

The procedure for placing under vacuum, then, is the same as in the case of the pump 120 described previously. On first operation of the pump 120, air is forced out from the pump, while the product is aspirated on the return stroke.

In the approximately upright position of the pump 120, with the adapter 20 in FIGS. 1 and 2, the product is aspirated through the ascending pipe 32 during the return stroke. The product flows around the non-return valve 50 and fills the pump chamber 180. When this occurs, the inlet or sleeve valve 48 remains closed. During the pumping stroke, some of the product, which is not located in the pump chamber 180, is forced downward through the adapter 20 past the non-return valve 50 through the ascending pipe 32, because the non-return valve 50 is kept from reaching its closing position by the V-shape of the end of the ascending pipe or ribs on the adapter 20 and retained in what is referred to as its throttling position.

In the upside-down position of the pump 120 with the adapter 20, not shown in the figures, the non-return valve 50 drops onto its throttling or ball seat and seals the non-return valve seat 54 during the return stroke. As a result of this sealing, a vacuum is produced in the pump chamber 180, as a result of which the flexible inlet valve 48 bulges inward and, as a consequence thereof, is opened. As a result, the product is aspirated into the pump 120 through the inlets 46 in the adapter 20 and past the inlet valve 48. When the filling operation has ended, the inlet valve 48 closes and the product can be dispensed, as usual, from the pump camber 180.

FIG. 2 shows a second embodiment of an adapter 20*a*, which in turn is attached to the same pump 120 as in FIG. 1. In the adapter 20*a*, a sleeve-shaped inlet valve 48*a* is provided in the region of its sleeve base 64*a* with an annular sealing flange 66*a*, which rests sealingly on a smoothly cylindrical longitudinal section 67*a* of the interior wall of the adapter housing 34*a* and is supported on the upper end faces of supporting ribs 70*a* at a distance below the lower end of the connecting nipple 130*a* of the housing 148*a* of the pump 120*a*.

A valve sleeve 62*a* of thin wall thickness consists here, again, of elastically flexible material and engages with its upper end into the connecting nipple 130*a* of the pump housing 148*a*. The valve sleeve 62*a* normally rests sealingly, over a short length, on an interior wall 76*a* of the lower end of the connecting nipple 130*a* of the adapter housing 34*a*, in a manner such that, in the event of a reduced pressure within the adapter housing 34*a*, the wall of the valve sleeve 62*a* is caused to bulge inward by the inflowing fluid under the effect of the pressure difference and permits the entry of the fluid into the adapter housing 34*a*.

The inlet consists of at least one inlet slit, the inlet in the embodiment shown in FIG. 2 consisting of three inlet slits 46*a*, which are disposed at equal circumferential angles in the interior wall of a connecting pipe 42*a* and extend between the connecting nipple 130*a* of the pump housing 148*a* and the upper connecting pipe 42*a* of the adapter housing 34*a* beyond the lower end of the connecting nipple 130*a* into the interior of the adapter housing 34*a*.

An upper edge of the connecting pipe 42*a* of the adapter housing 34*a*, which is secured on the outside of the connecting nipple 130*a* of the housing 148*a* of the dispensing device 22*a*, is cut out to form, in each case, an inlet port 47*a* for the respectively associated inlet slit 46*a*.

The inlet slits 46*a* extend downward beyond a lower edge of the connecting nipple 130*a* of the housing 148*a* and end at a distance above the sealing flange 66*a* of the inlet valve 48*a*, in order to form outlet ports 49*a* for each of the inlet slits 46*a*. These outlet ports 49*a* lie at a distance from and opposite to the outside of the valve sleeve 62*a* of the inlet valve 48*a*, protruding from the outside of the sleeve base 64*a* of the inlet valve 48*a*.

Throttle ports 58*a* in the base of the adapter housing 34*a*, on which the spherical non-return valve 50*a* lies in the upright position of the container, are provided with at least three bypass flow channels 60*a*.

It can be seen that the adapter 20*a* in FIG. 2 has a shorter overall length and a smaller dead volume in the adapter housing 34*a*.

Figure 3:
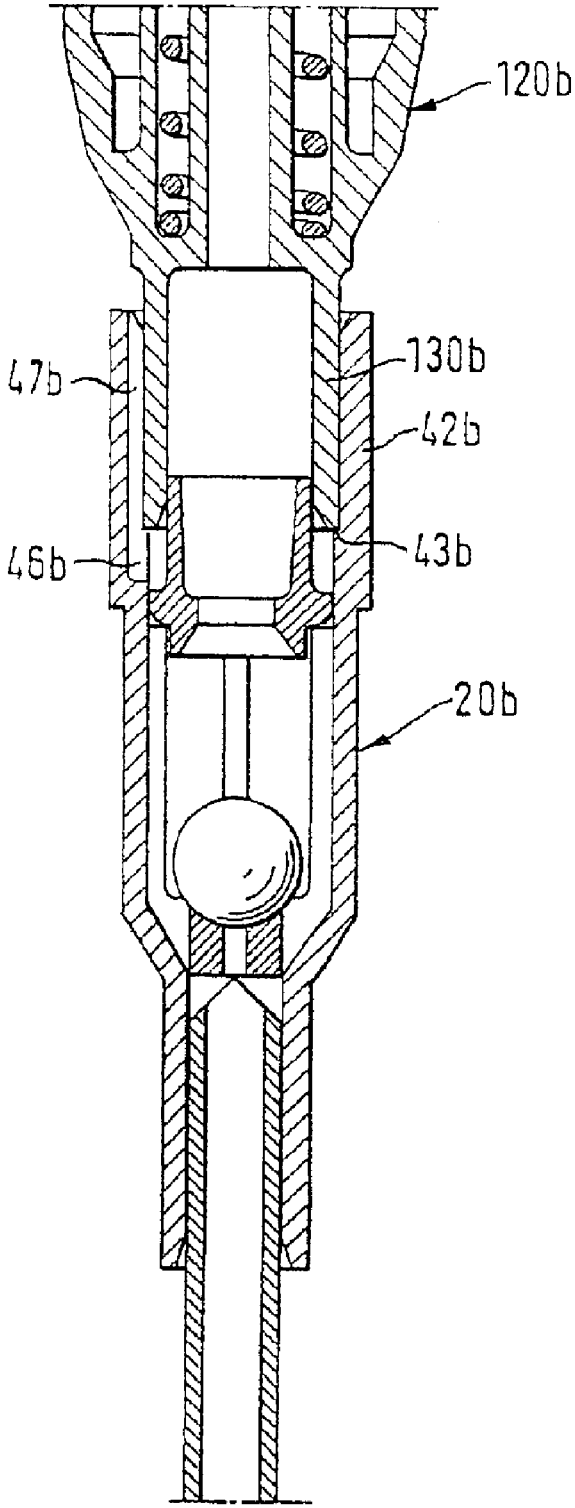
FIG. 3 shows a modification of the adapter in FIG. 2 on a larger scale, with the pump largely broken away.

FIG. 3 shows an adapter 20*b* whose connecting pipe 42*b* is widened in diameter and provided with a greater wall thickness. A plurality of inlet slits 46*b*, extending parallel to the axis and disposed at equal circumferential angular intervals, are limited in the circumferential direction by longitudinal ribs 47*b* on the interior wall of the connecting pipe 42*b*. In addition, the longitudinal ribs 47*b* are each provided, at a distance below their lower ends of equal height, with a stop shoulder 43*b*, on which stop shoulders 43*b* the lower end face of a connecting nipple 130*b* of a pump 120*b* forming the dispensing device rests.

Figure 4:
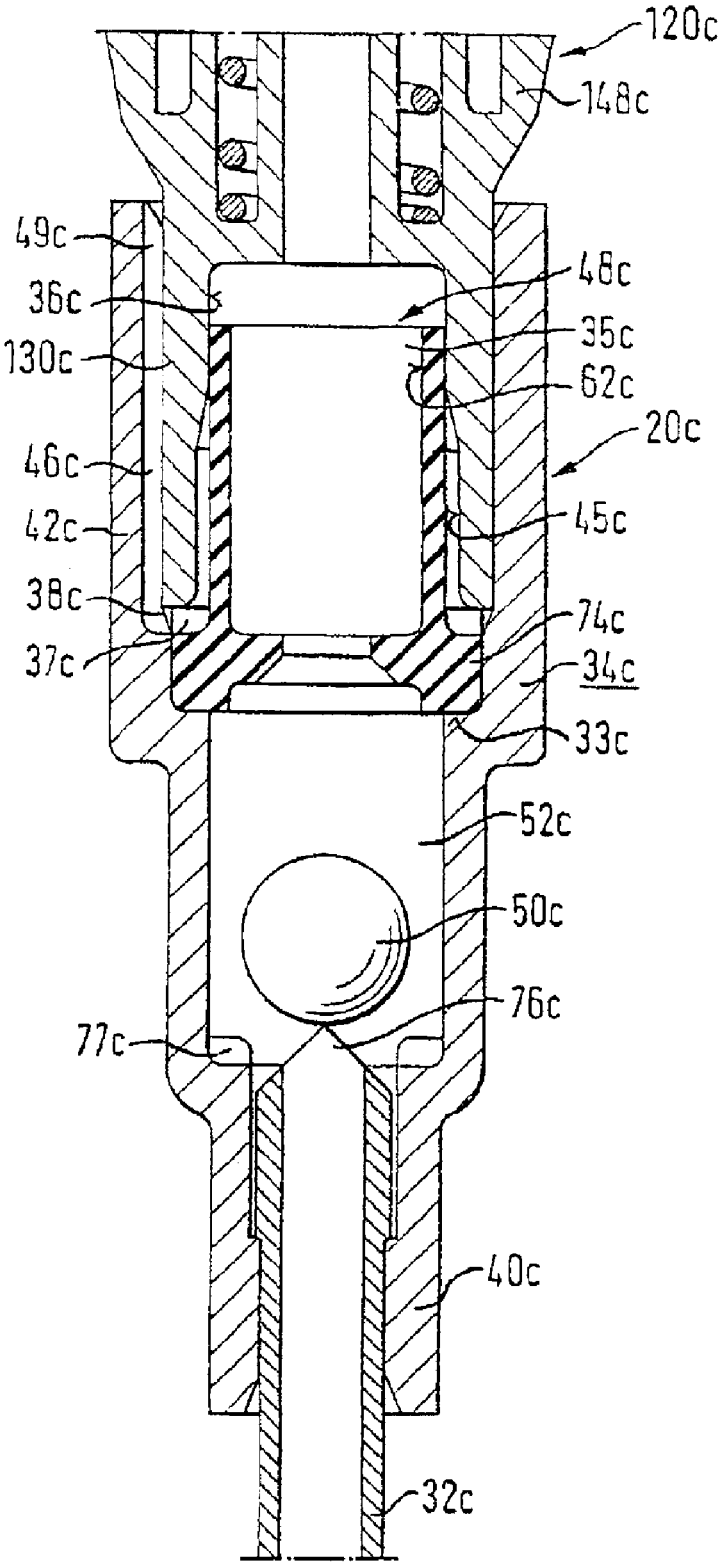
FIG. 4 shows a further modification of the adapter in FIG. 3, in a central longitudinal section on a larger scale.

In the embodiment of an adapter 20*c* in FIG. 4, a flexible valve sleeve 62*c* of the inlet or sleeve valve 48*c* extends over substantially its entire length into a connecting nipple 130*c* of a pump housing 148*c* and normally lies sealingly only with the outside of its upper free end 35*c* on an interior wall 36*c* of the connecting nipple 130*c*.

Below this abovementioned sealing region between inlet valve 48*c* and connecting nipple 130*c*, the interior wall of the connecting nipple 130*c* is widened at 45*c* in order to facilitate the installation of the inlet valve 48*c* and the lifting away of the upper end 35*c* of the inlet valve 48*c* from the interior wall of the connecting nipple 130*c*. Inlet slits 46*c* extend between the connecting pipe 42*c* of the adapter housing 34*c* and the connecting nipple 130*c* of the housing 148*c* of the dispensing device 120*c*.

The adapter housing 34*c* is provided above a valve chamber 52*c* with an inner annular shoulder 33*c* on which an annular flange 74*c* of the inlet valve 48*c* is supported. The clear diameter of the annular shoulder 33*c* approximately corresponds to the clear diameter of the connecting nipple 130*c* of the pump housing 148*c*. At least three stops 38*c* are molded on the top of the annular shoulder 33*c*, are disposed at equal circumferential angular intervals, rest on the lower end face of the connecting nipple 130*c* and form radially inward-extending passage channels 37*c* for the fluid product that are flush with the inlet slits 46*c* and make a transition into the annular space between connecting nipple 130*c* and valve sleeve 62*c*.

In this arrangement, a longitudinal section of the adapter housing 34*c* extends below the annular shoulder 33*c* and forms a smoothly cylindrical interior wall of the valve chamber 52*c* for a non-return valve 50*c*. Here again, the diameter of the valve chamber 52*c* is substantially greater than the diameter of the spherical non-return valve 50*c*, so that good flow around the non-return valve 50*c* is achieved.

The longitudinal ribs 49*c* separate the inlet slits 46*c* in the circumferential direction of the interior wall of the upper end, forming the connecting pipe 42*c*, of the adapter housing 34*c*. The stops 38*c* are disposed at an equal axial height at a distance above the inner annular shoulder 33*c* of the adapter housing 34*c*.

It is further apparent from FIG. 4 that the upper end, protruding into the valve chamber 52*c*, of an ascending pipe 32*c* projects with its gable-shaped tip 76*c* above the height of bearing webs 77*c* out into the valve chamber 52*c*, so that the spherical non-return valve 50*c* exposes a relatively large through-flow cross section. It can also be seen that the overall height of the adapter 20*c* is exceptionally small, because of the connecting pipe 42*c* engages over approximately its full length over the connecting nipple 130*c* and, in addition, the inlet valve 48*c* engages almost completely over the connecting nipple 130*c*. Because of this compact arrangement of said parts, stable mounting of the adapter housing 34*c* and of the ascending pipe 32*c* in an ascending pipe nipple 40*c* of the adapter 20*c* is guaranteed.

Figure 5:
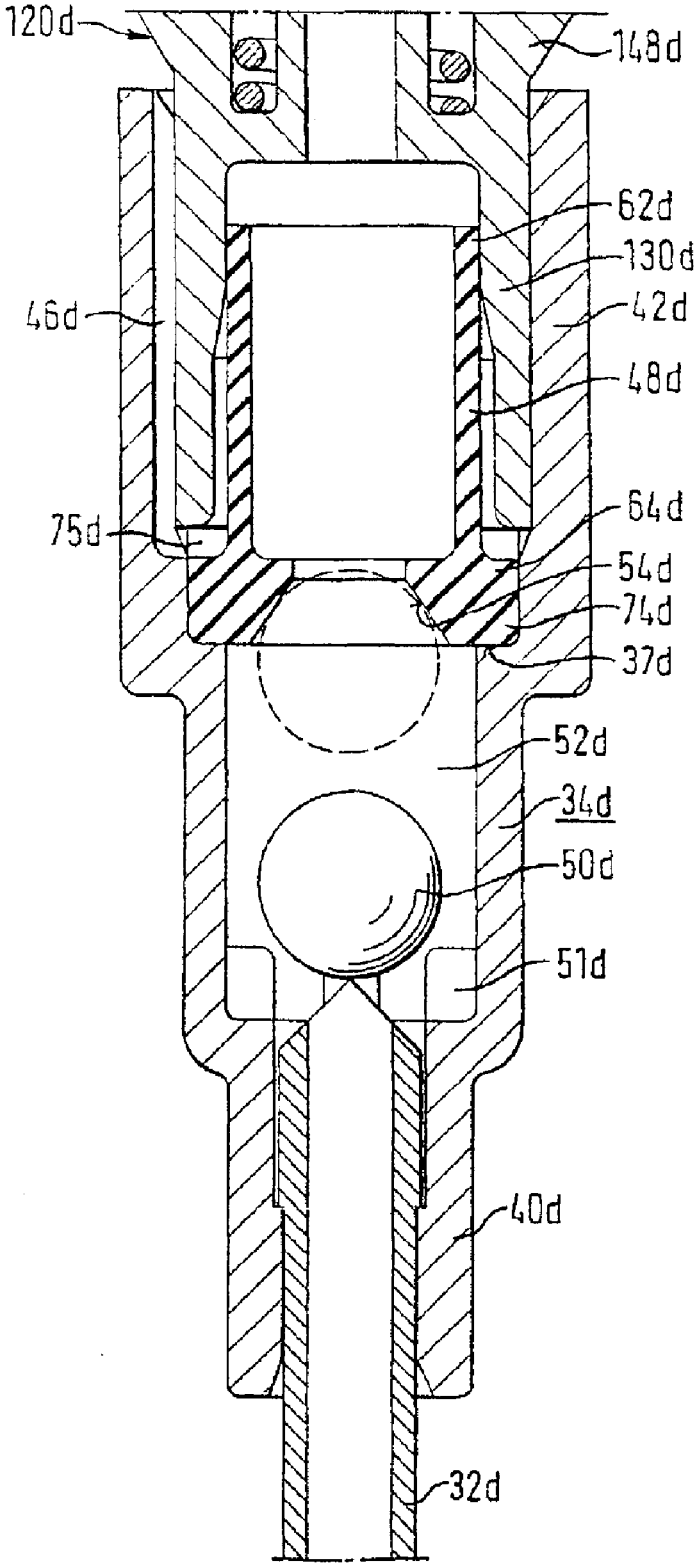
FIG. 5 shows a further modification of the adapter in FIG. 3, in a central longitudinal section on a larger scale.

FIG. 5 shows a modified embodiment of an inlet valve 48*d*, whose non-return valve seat 54*d* exhibits a 45° angle for optimum sealing by a spherical non-return valve 50*d*. A sleeve base 64*d* is provided with a radially outward-projecting sealing flange 74*d*, which is mounted sealingly on an inner annular shoulder 37*d* of an adapter housing 34*d*. The top of the sealing flange 74*d* is provided with four ribs 75*d* disposed at equal circumferential angles, these extending as far as the outer circumference of the sealing flange 74*d* and serving as a stop for the lower end of a connecting nipple 130*d*. The interior wall of a connecting pipe 42*d* of the adapter housing 34*d* is provided with three axial inlet slits 46*d* disposed at equal circumferential angular intervals and guided in a U-shape around the connecting nipple 130*d*, as is apparent on the left-hand side of FIG. 5.

In FIG. 5, as in FIG. 4, the inlet slits 46*d* of U-shaped cross section also ensure that the upper end of the valve sleeve 62*d*, which exclusively rests sealingly on the interior wall of the connecting nipple 130*d*, can easily be lifted off from the interior wall of the connecting nipple 130*d* and opened in the event of a pressure difference between the two sides of this sealing region.

Above the base of a valve chamber 52*d*, four ribs 51*d* are provided at equal circumferential angular distances and ensure that, in the event of an ascending pipe 32*d* not being completely inserted into the ascending pipe nipple 40*d*, the spherical non-return valve 50*d* does not block off the adapter housing 34*d* in the event of a pump stroke in the upright position of the pump 120*d*.

Figure 6:
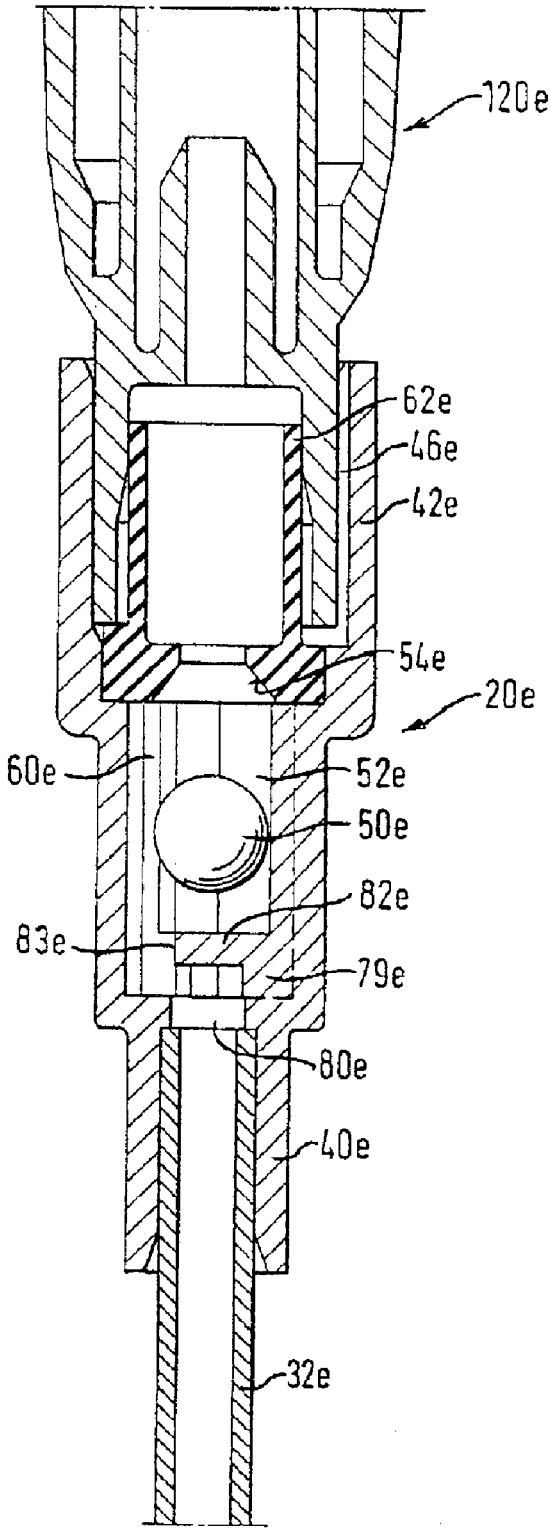
FIG. 6 shows a further modification of the adapter in FIG. 3, in a central longitudinal section on a larger scale.

FIG. 6 shows a modified embodiment of an adapter 20*e* according to the invention, wherein, at a distance above a passage aperture 80*e* in the base of a valve chamber 52*e* for a spherical non-return valve 50*e*, a baffle plate 82*e* is disposed at an axial distance above the passage aperture 80*e*. The free front end 83*e* of the baffle plate 82*e* extends from the interior wall of the valve chamber 52*e* at a distance above the passage aperture 80*e* and ends at a distance in front of the diametrally opposite side. The baffle plate 82*e* masks the passage aperture 80*e*, in a manner such that the fluid flow from an ascending pipe 32*e* is deflected against the interior wall of the valve chamber 52*e* and the flow can pass around the spherical non-return valve 50*e*, so that it remains open during the suction stroke of the pump 120*e* or when the dispensing valve of a pressure container is open.

Figure 7:
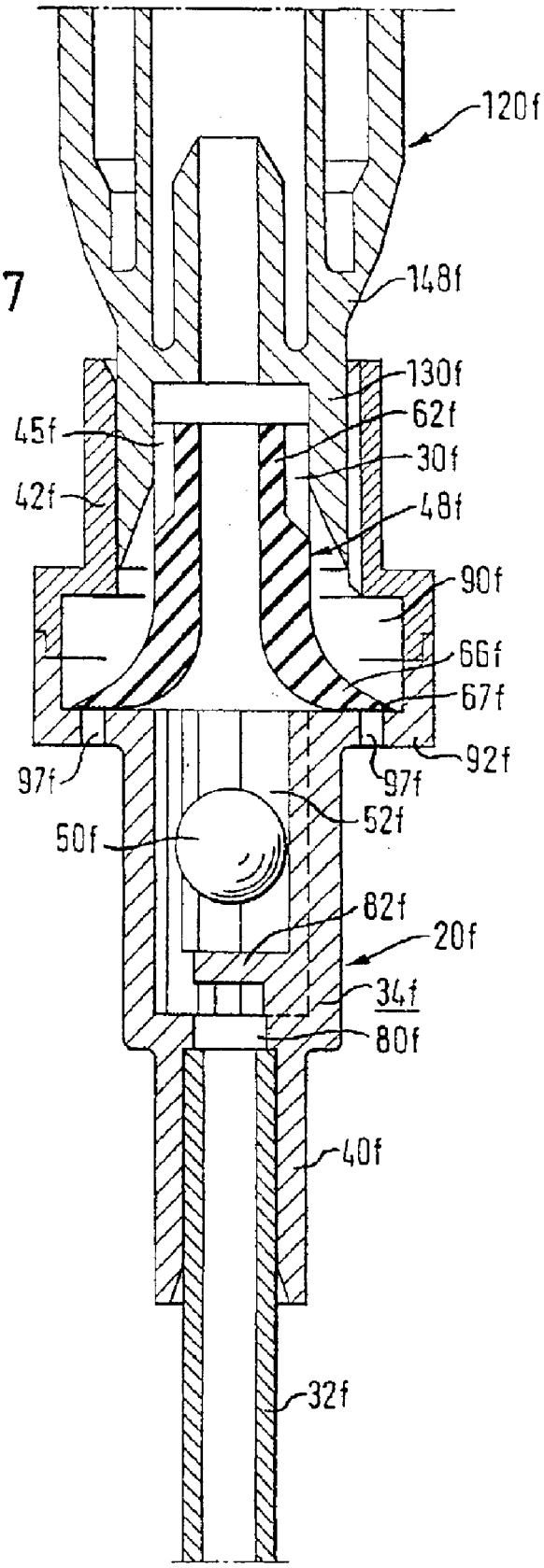
FIG. 7 shows a further embodiment of an adapter according to the invention, in a central longitudinal section.

FIG. 7 shows a modified embodiment of an adapter 20*f* and of an inlet valve 48*f*, whose lower edge 67*f* is configured as an annular sealing flange 66*f* and comprises an increasingly small wall thickness toward its outer edge. The inlet valve 48*f* consists, as in all cases described, of elastically flexible material, such as silicone or PE, and is again configured above the sealing flange 66*f* as a valve sleeve 62*f* which is inserted by its upper end into a connecting nipple 130*f* of a pump house 148*f*. The upper end of the valve sleeve 62*f* is provided on its circumference with ribs 45*f* that form passage channels 30*f*, which provide a link between the pump housing 148*f* and the interior of the container.

The adapter 20*f* has an adapter housing 34*f*, which contains a widened sealing flange chamber 90*f* and is therefore produced in two parts. The sleeve-shaped inlet valve 48*f* is provided at its lower end with the sealing flange 66*f*, whose diameter is substantially greater than that of the upper valve sleeve 62*f*, whose lower end is formed by the sealing flange 66*f*. A base 92*f* of this sealing flange chamber 90*f* is provided with a plurality of inlet ports 97*f* for the fluid, disposed at equal circumferential intervals, which are normally sealed by the sealing flange 66*f*, which is increasingly thin and therefore more flexible toward its outer edge, the flange in the sealing flange chamber 90*f* resting sealingly on the inlet ports 97*f*. In the upside-down position of the device, the sealing flange 66*f* is lifted away from the inlet ports 72*f* during a suction stroke of the pump 120*f*, so that the fluid product can be aspirated from the container into the pump housing 148*f*. A baffle plate 82*f* is likewise disposed in a valve chamber 52*f* for a spherical non-return valve 50*f*. By contrast with the embodiment shown in FIGS. 6 and 7, the baffle plate may also be round in shape and disposed coaxially with and at a distance above a passage aperture 80*f* in the base of the valve chamber 52*f*, at least three thin webs linking the baffle plate to the base, of annular shoulder shape, of the valve chamber 52*f*.

The embodiment of the adapter in FIGS. 8 to 15 differs from that in FIGS. 1 to 7 primarily in that the inlet valve and the adapter are produced in one piece.

Figure 8:
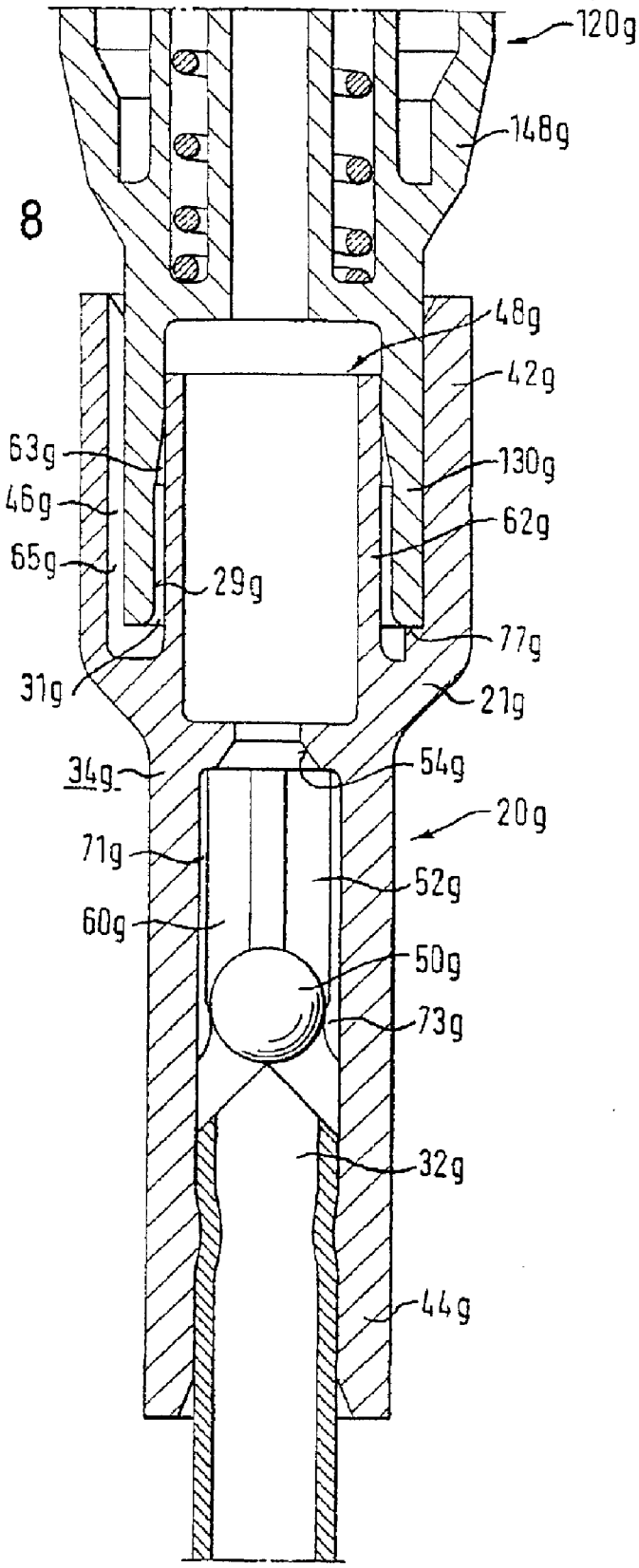
FIG. 8 shows a further embodiment of an adapter according to the invention, which is integrally molded with a housing of the dispensing device, in a central longitudinal section.

FIG. 8 shows an adapter 20*g* which is formed in one piece with a sleeve-shaped inlet valve 48*g*. A connecting pipe 42*g* of the adapter 20*g* surrounds a valve housing 62*g* at a distance, so that, in the cross section shown in FIG. 8, they form U-shaped legs of an annular space 63*g* for a connecting nipple 130*g* of a pump housing 148*g*. In this embodiment, again, a plurality of inlet slits 46*g* are provided on the inside of the connecting pipe 42*g* and are separated by longitudinal ribs 65*g* on the interior wall of the connecting pipe 42*g*. These longitudinal ribs end at their lower ends in stop shoulders 77*g* for the lower end face of the connecting nipple 130*g* of the pump housing 148*g*, which are disposed at a radial distance from the exterior wall of the valve sleeve 62*g*.

The connecting nipple 130*g* is provided over approximately three quarters of its length and on the inside with a widened portion 29*g*, which forms an annular space 31*g* with the exterior wall of the valve sleeve 62*g*, this annular space 31*g* forming, in the cross section shown in FIG. 8, the inner leg of the U-shaped inlet slit 46*g* and ending only immediately in front of the upper end of the valve sleeve 62*g* which seals the inlet slits 46*g* relative to the interior wall of the connecting nipple 130*g*. The annular space 31*g* narrows toward the upper end, resting on the interior wall of the connecting nipple 130*g*, of the valve sleeve 62*g* in a manner such that the sealing, upper end of the valve sleeve 62*g* can more easily be lifted away by the fluid product from the interior wall of the connecting nipple 130*g* in the opening direction.

The lower end of a conical longitudinal section 21*g* of the adapter housing 34*g* is formed by a non-return valve seat 54*g* for a spherical non-return valve 50*g* within a valve chamber 52*g*. The substantially cylindrical valve chamber 52*g* is provided at equal circumferential intervals with longitudinal ribs 71*g*, which guide the spherical non-return valve 50*g* axially at a radial distance from the interior wall of the valve chamber 52*g* and thus form bypass flow channels 60*g*, through which the fluid product of the container can flow around the non-return valve 50*g*.

The lower ends of the longitudinal ribs 71*g* are configured as radially inward-projecting bearing beadings 73*g* for the spherical non-return valve 50*g*. Below the seat for the non-return valve 50*g* formed by the bearing beadings 73*g*, the upper end, again pointed in the manner of a gabled roof, of an ascending pipe 32*g* is inserted and retained in an axially immovable manner by a constriction of the interior wall of an ascending pipe nipple 44*g*.

The interior diameter of the valve chamber 52*g* and of the ascending pipe connector 44*g* are again of equal size, in the same way as the exterior diameter of the valve chamber 52*g* and of the ascending pipe connector 44*g*.

Figure 9:
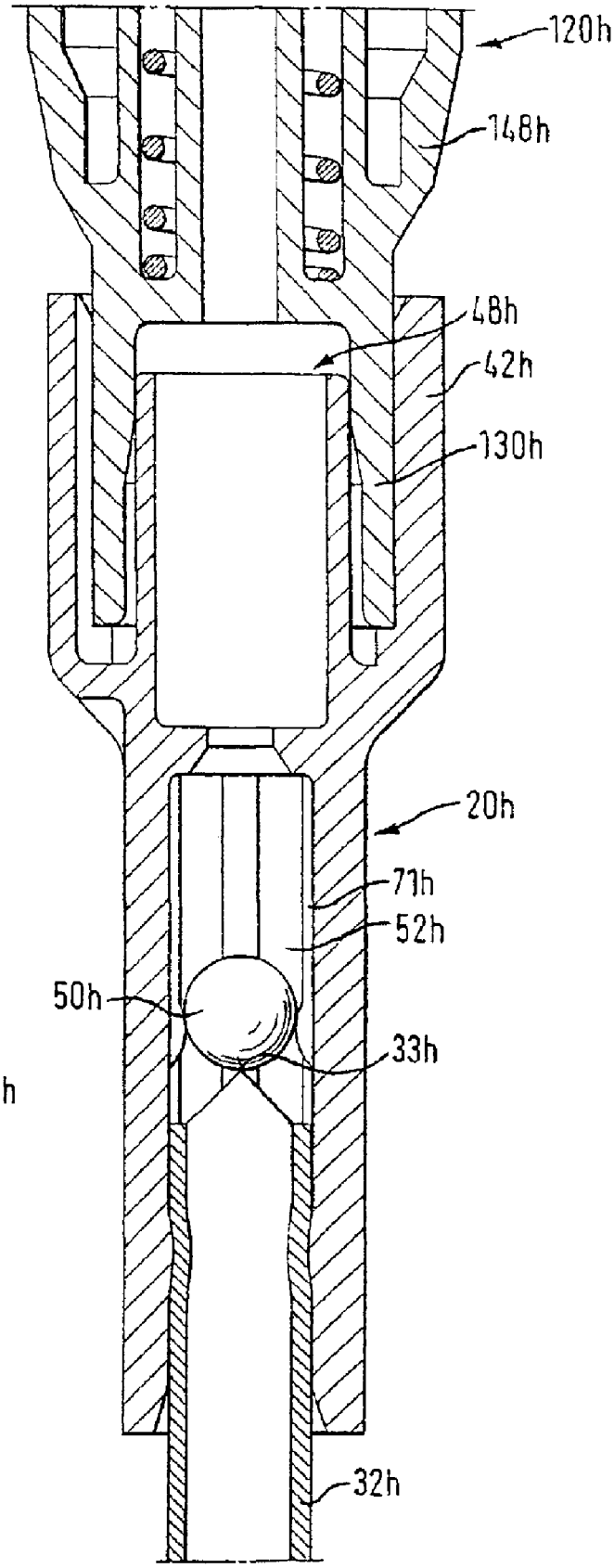
FIG. 9 shows a modification of the adapter in FIG. 8, in a central longitudinal section.
Figure 10:
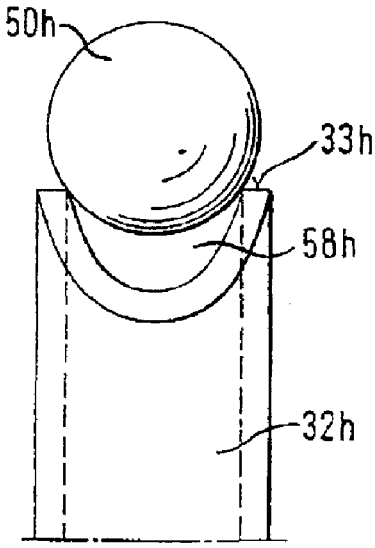
FIG. 10 shows a non-return valve of the adapter in FIG. 9, in a view rotated through 90°, on a larger scale.

The modification of an adapter 20*h* shown in FIG. 9 relates solely to the support of a spherical non-return valve 50*h*, which is supported solely by the two diametrally opposite tips 33*h* of an ascending pipe 32*h*, throttle ports 58*h* being left free. Accordingly, longitudinal ribs 71*h* in a valve chamber 52*h* for the non-return valve 50*h* are provided over their entire length with the same cross section, so that the non-return valve 50*h* is axially guided by the longitudinal ribs 71*h* in the axial direction only at a radial distance from the interior wall of the valve chamber 52*h*. FIG. 10 clarifies, in a view rotated through 90°, the position of the spherical non-return valve 50*h* on the end, cut to the shape of a gabled roof, of the ascending pipe 32*h*.

Figure 11:
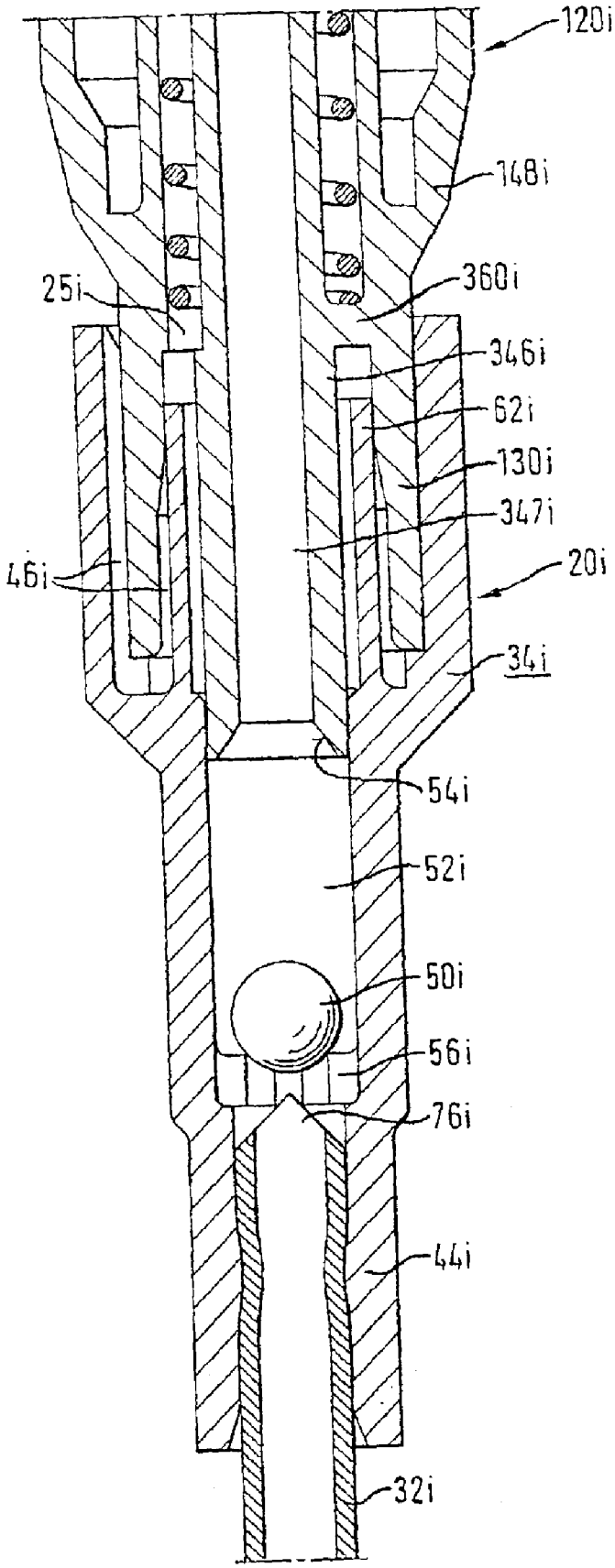
FIG. 11 shows a modification of the adapter in FIG. 8, in a central longitudinal section.

FIG. 11 shows an embodiment in which both a housing 148*i* of a pump 120*i* and an adapter 20*i* are modified. A base 360*i* of the pump housing 148*i* is provided with passage channels 25*i*, a tubular guide pin 346*i* extending beyond the base 360*i* of the pump housing 148*i* freely downward through a valve sleeve 62*i* and engaging only with its lower end into a valve chamber 52*i* for a spherical non-return valve 50*i* and closing the valve chamber 52*i* in the direction of the pump 120*i*. At the same time, the lower end of this tubular guide pin 346*i* forms a non-return valve seat 54*i* for the non-return valve 50*i*.

In the lower end of the valve chamber 52*i*, a supporting device 56*i* for the spherical non-return valve 50*i* is again provided, as has already been described above in connection with FIG. 1. At a distance below this supporting device 56*i*, again, the upper end 76*i*, cut to the shape of a gabled roof, of an ascending pipe 32*i* inserted into an ascending pipe nipple 44*i* is identifiable.

The upper end of the valve sleeve 62*i* again forms a flexible seal relative to the interior wall of a connecting nipple 130*i* of the pump housing 148*i*, inlet slits 46*i*, as in FIGS. 8 and 9, being provided in connection with the upper end of the adapter 20*i*.

In order that the upper, normally sealing end of the valve sleeve 62*i* can lift away from the cylindrical interior wall of the connecting nipple 130*i* in the event of a pressure difference, the cylindrical interior wall of the valve sleeve 62*i* is disposed at a radial distance from the cylindrical circumference of the tubular guide pin 346*i*, through which a passage channel 347*i* extends. It can be seen that the cylindrical interior diameter of the smooth-walled valve chamber 52*i* is a smaller size than the interior diameter of the valve sleeve 62*i* and is exactly matched to the exterior diameter of the guide pin 346*i*, in order to ensure a seal between the guide pin 346*i* and the interior wall of the valve chamber 52*i*. In this region, the adapter housing 34*i* is again shaped to taper conically toward the valve chamber 52*i*.

Figure 12:
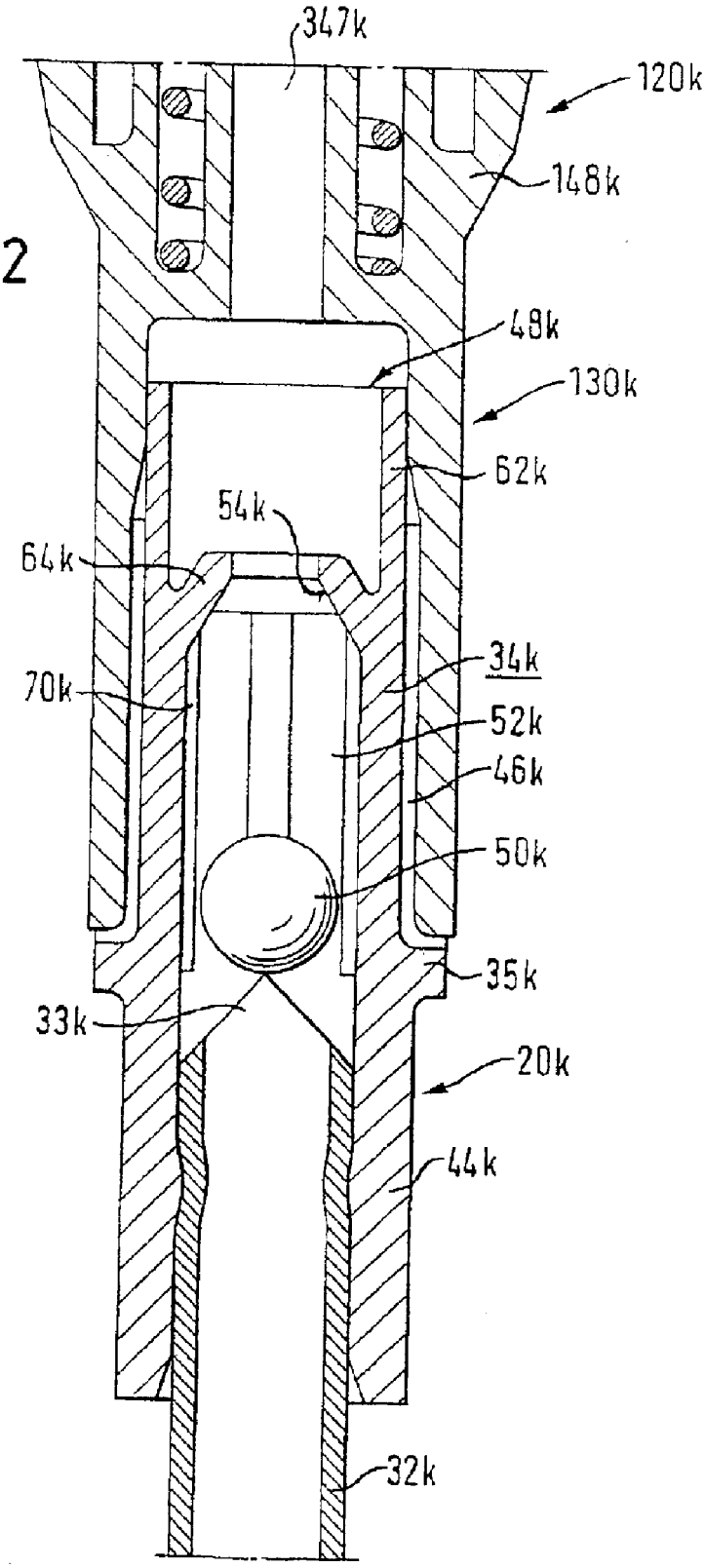
FIG. 12 shows a modification of the adapter in FIG. 8, in a central longitudinal section.

FIG. 12 shows a further embodiment of an adapter 20*k* with an adapter housing 34*k*, which is of extremely compact design and combines with one another in a compact construction a sleeve-shaped inlet valve 48*k*, a non-return valve seat 54*k* for a spherical non-return valve 50*k* and an ascending pipe nipple 44*k*. In the present example of embodiment, a connecting nipple 130*k* of a pump housing 148*k* is extended to the point where it comprises not only a valve sleeve 62*k* but also a valve chamber 52*k* as far as the height of the open end position of the spherical non-return valve 50*k*. The adapter housing 34*k* is there provided with an annular flange 35*k* whose outside is approximately flush with the outer circumference of the connecting nipple 130*k*.

The interior wall of the connecting nipple 130*k* is widened upward as far as the vicinity of a sleeve base 64*k*, to form inlet slits 46*k* which are disposed on the outside of the wall of the adapter housing 34*k* surrounding the valve chamber 52*k* and extend from the annular flange 35*k* to a height below the throttle valve seat 54*k* for the non-return valve 50*k*.

The spherical non-return valve 50*k* is supported, in its lower, open end position, only by the tips 33*k* of an ascending pipe 32*k*, as was described in detail in connection with FIG. 9. In the reversed position of the device shown in FIG. 12, a pressure difference acting on the fluid, as described, will lift the upper end of the valve sleeve 62*k* inward away from the interior wall of a connecting nipple 130*k*, so that the fluid product can penetrate through an aspiration channel 347*k* into the housing 148*k* of the pump 120*k*.

Figure 13:
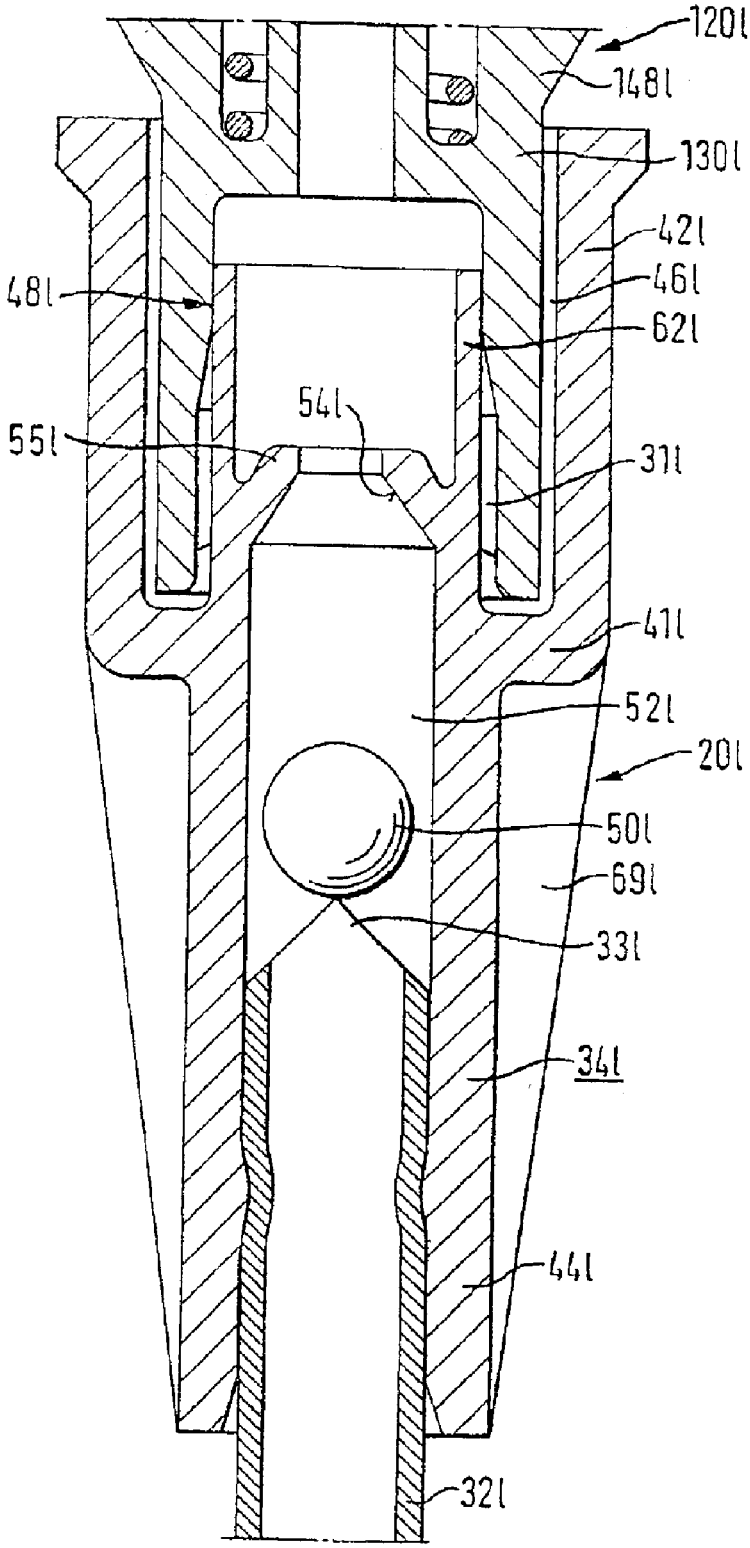
FIG. 13 shows a modification of the adapter in FIG. 8, in a central longitudinal section.

Finally, FIG. 13 shown an adapter 20*l*, which engages with a connecting pipe 42*l* over a connecting nipple 130*l* of a housing 148*l* of a pump. 120*l* at a radial distance, forming a plurality of inlet slits 46*l*. The inlet slits 46*l* are again disposed with a U-shaped cross section, so that they also extend between the exterior wall of a valve sleeve 62*l* until immediately in front of the upper end thereof, which is again flexibly configured and rests sealingly on the interior wall of the connecting nipple 130*l* in the upright position and in the inactive state of the device. The interior wall of the connecting nipple 130*l* is provided with longitudinal ribs 31*l*, which separate the inlet slits 46*l* from one another in the circumferential direction. Preferably, three or four such inlet slits 46*l* are provided.

In the mounted position of the adapter 30*l*, a non-return valve seat 54*l* is disposed within the connecting nipple 130*l*. As the non-return valve seat 54*l* is formed by an annular wall

55*l* tapering conically toward the upper end of the adapter 20*l*, the length of an adapter housing 34*l* can be economized on or the distance between the closed position and the lower, open position of a spherical non-return valve 50*l* can be increased. An ascending pipe nipple 44*l* for an ascending pipe 32*l* is provided on the outside with reinforcing ribs 69*l*, which extend from the lower end of the ascending pipe nipple 44*l* to the lower end of the upper connecting pipe 42*l*, which is set on a shoulder 41*l* which extends radially outward from the exterior wall of the adapter 20*l* at a distance below the non-return valve seat 54*l*. The connecting pipe 42*l* in turn forms, together with the valve sleeve 62*l*, an inlet valve 48*l*, the connecting nipple 130*l* engaging into the connecting pipe 42*l*, so that the valve sleeve 62*l* seals the connecting nipple on the interior wall. It can further be seen that a valve chamber 52*l* is of smoothly cylindrical design and has a much greater diameter than the spherical non-return valve 50*l*, which is held in its lower, open position merely by tips 33*l* of the ascending pipe 32*l* and, consequently, a large free cross section is available between the spherical non-return valve 50*l* and the interior wall of the valve chamber 52*l* for the aspiration of the fluid product into the housing 148*l* of the pump 120*l* in its upright position.

The above description of numerous examples of embodiment of the invention gives an impression of the advantages achieved by means of the adapter according to the invention. These consist in the use of a positive contact seal for the upright dispensing position of the dispensing device in comparison with a ball valve in the case of conventional systems. In addition, all components, specifically the housing of the dispensing device, the adapter and the ascending tube are oriented coaxially with one another. Finally, the basic concept of the invention of using three parts for a large number of immersion pipe sizes can be applied to reduce costs and/or improve performance. Not least, the positive contact seal achieved by means of the sleeve-shaped inlet valve in every type of upside-down position of the device achieves a substantially uniform output performance of the dispensing device. Furthermore, immersion pipes and valve balls of different sizes can be used in connection with the adapter according to the invention. Moreover, there are a plurality of possibilities for retaining the ball valve in the adapter and securing it on the housing assigned to a pump or a valve. Finally, the invention can be embodied with a minimum number of parts.

What is claimed is:

1. An adapter (20) for a hand-operated dispensing device (120) for a fluid in a container wherein fluid can be placed under pressure in a container in the substantially upright position thereof and in the substantially reversed or upside-down position thereof, and wherein the dispensing device (120) includes a base with a lower end, a connecting nipple (130) that is located at said base lower end and that has an interior wall (36*c*), an ascending pipe (32) extending into the fluid in the container, and an inlet suction channel (348) which extends through the base and connecting nipple (130) and is in communication with the ascending pipe (32) to accommodate the passage of the fluid in the substantially upright position of the container, and a housing (148) that defines a housing passage channel (30) in communication with said inlet suction channel (348), said adapter (20) comprising:

a) a tubular adapter housing (34) and a linking channel (36) which is defined in said tubular adapter housing (34) between the ascending pipe (32) and the housing passage channel (30) of the housing (148) of the dispensing device (120), the tubular adapter housing (34) further comprising a connecting pipe (42) for connecting the tubular adapter housing (34) to the connecting nipple (130) and further comprising an ascending pipe connector (44) for connecting the tubular adapter housing (34) to the ascending pipe (32), said tubular adapter housing (34) further including a valve chamber (52);

b) a plurality of inlets (46) for the fluid in the substantially upside-down or reversed position of the container and dispensing device (120), the tubular adapter housing (34) forming at least part of the inlets (46);

c) an inlet valve (48, 48*a*, 48*c*, 48*d*) within the tubular adapter housing (34) for the approximately simultaneous closure of the inlets (46) in the substantially upright position of the container, but for the approximately simultaneous opening of the inlets (46) in the event of a pressure acting on the fluid in the container in the substantially upside-down or reversed position of the container;

d) a spherical non-return valve (50), disposed within the valve chamber (52) of the tubular adapter housing (34) so as to be freely movable axially between two end positions which are an upper end position defined by a non-return valve seat (54) extending transversely through the tubular adapter housing (34) and a lower end position defined by a supporting device (56) in the upright position of the container, said supporting device (56) defining at least one throttle port (58), said non-return valve (50) being adapted to engage said supporting device (56) to adopt a throttle position for the fluid so as to leave said at least one throttle ports (58) open; and wherein e) said valve chamber (52) has a diameter which is greater in size than the diameter of the non-return valve (50) to define a bypass flow channel (60) for the fluid in the upright position of the container;

f) the inlet valve (48) consists of a valve sleeve (62) of slight wall thickness of elastic material and a sleeve base (64, 74*c*, 74*d*), which is inserted into the tubular adapter housing (34) to be non-displaceable axially and is supported within the tubular adapter housing (34) to extend a distance below the inlets (46), the valve sleeve (62) extending into the connecting nipple (130*c*) of the dispensing housing (148*c*) and having an upper free end (35*c*) with an exterior surface sealingly engaging the interior wall (36*c*) of the connecting nipple (130*c*) in the substantially upright position of the container in a manner such that, in the event of a reduced pressure within the adapter housing (34), the wall of the valve sleeve (62) is caused to bulge inward in the opening direction by the inflowing fluid under the action of the pressure difference;

g) at least a portion of the tubular adapter housing (34*a*) has a smooth, cylindrical interior wall, and the tubular adapter housing (34*a*) has an annular shoulder (33*c*) located above the non-return valve (50*c*) so that the non-return valve (50*c*) is below the annular shoulder (33*c*) and so that the valve chamber (52*c*) for the non-return valve (50*c*) extends below said annular shoulder (33*c*);

h) the sleeve base (64) has an annular sealing flange (74*a*, 74*c*, 74*d*) which lies sealingly on the smooth, cylindrical interior wall of the tubular adapter housing (34*a*) at a distance below the lower end of the inlets (46*a*) and below the lower end of the connecting nipple (130*a*) and which is supported on the annular shoulder (33*c*) of the tubular adapter housing (34*c*, 34*d*);

I) the sleeve base (64*d*) of the valve sleeve (48*c*, 48*d*) has a seat (54*d*, 54*e*) with an angle of about 45° for the spherical return valve (50*c*, 50*d*, 50*e*);

j) the inlets (46*a*, 46*b*, 46*c*, 46*d*, 46*e*) are inlet slits (46*a*, 46*b*, 46*c*, 46*d*, 46*e*) which extend between the connecting nipple (130*a*, 130*b*, 130*c*, 130*d*, 130*e*) of the housing (148, 148*c*, 148*d*) of the dispensing device (120, 120*c*, 120*d*, 120*e*) and the connecting pipe (42*a*, 42*b*, 42*c*, 42*d*, 42*e*) of the tubular adapter housing (34*a*, 34*b*, 34*c*, 34*d*, 34*e*) beyond the lower end of the connection nipple (130*a*) into the interior of the tubular adapter housing (34*a*);

k) the tubular adapter housing (34*c*) has an upper tubular end defining a cylindrical interior wall;

l) the inlet slits (46*c*) are arranged in the cylindrical interior wall of the upper tubular end of the tubular adapter housing (34*c*) and are spaced radially outwardly from the valve sleeve (62*c*); and m) stops (38*c*, 75*d*) are located between the base (64, 64*d*) of the inlet valve (48*a*, 48*c*, 48*d*) and the connecting nipple (130*c*, 130*d*) so as to extend radially relative to the interior wall of the tubular adapter housing (34*c*) to define the lower end of the inlet slits (46*c*, 46*d*, 46*e*) at a distance below the lower end of the connecting nipple (130*c*) and define inlet passage channels (37*c*) communicating with the inlet slits (46*c*).

2. The adapter as claimed in claim 1, wherein the tubular adapter housing (34*c*) has a longitudinal section extending below said annular shoulder (33*c*, 37*d*) and forming a smooth cylindrical interior wall of the valve chamber (52*c*, 52*d*) for the non-return valve (50*c*, 50*d*).

3. The adapter as claimed in claim 1, wherein said tubular adapter housing (34*c*) has longitudinal ribs (49*c*) which separate the inlet slits (46*c*) from one another in the circumferential direction around the interior wall of the upper, tubular end of the tubular adapter housing (34*c*); and wherein said ribs (49*c*) extend to the same axial height as the stops or ribs (38*c*, 75*d*) at the lower end of the connecting nipple (130*c*) of the housing (148*c*) of the dispensing device (120*c*).

4. The adapter as claimed in claim 1, wherein the valve chamber (52*c*) has an annular base lying on a plane;

wherein the ascending pipe (32*c*) has a bore and has an upper end that extends from both sides of a plane in which the bore of the ascending pipe (32*c*) extends; and wherein the upper end of the ascending pine (32*c*) is cut off at an angle of 45° so that two mutually opposite tips (76*c*) of the ascending pipe end project above the plane of the annular base of the valve chamber (52*c*) to support the non-return valve (50*c*).

5. The adapter as claimed in claim 4, wherein said stops (38*c*, 75*d*) are molded as a unitary portion of any of the following: (1) said inlet valve base (64, 64*d*), (2) said tubular housing (34*c*), and (3) said connecting nipple (130*c*).

6. The adapter as claimed in claim 1, wherein the tubular adapter housing (34) has a base and has an aperture (80*e*) in the base; and wherein a baffle plate (82*e*) is disposed at a distance above the aperture (80*e*) in the base of the tubular adapter housing in order to guide the flow of fluid into the bypass flow channel (60*e*) for the non-return valve (50*e*) in the valve chamber (52*e*) when the container and dispensing device (120*e*) are in the upright position.

7. The adapter as claimed in claim 6, wherein the valve chamber (52*e*) of the tubular adapter housing (34) is defined by an interior wall; and wherein the baffle plate (82*e*) is connected via at least one bearing rib (79*e*) to the interior wall of the valve chamber (52*e*) of the tubular adapter housing so as to define a bearing structure for the non-return valve (50*e*) when the container and dispensing device (120*e*) are in the upright position.

8. The adapter as claimed in claim 1, wherein said stops have the form of ribs (75*d*) in the top of the sealing flange (74*d*) of the base (64*d*) of the inlet valve (48*d*).

* * * * *